US006718560B2

(12) United States Patent
Godoy

(10) Patent No.: US 6,718,560 B2
(45) Date of Patent: Apr. 13, 2004

(54) SWIMMING GOGGLES AND MANUFACTURING PROCESS THEREOF

(75) Inventor: Carlos Alberto Godoy, Genoa (IT)

(73) Assignee: Cressi-Sub S.p.A., Genoa (IT)

( * ) Notice: Subject to any disclaimer, the term of this patent is extended or adjusted under 35 U.S.C. 154(b) by 258 days.

(21) Appl. No.: 09/949,726

(22) Filed: Sep. 12, 2001

(65) Prior Publication Data

US 2002/0032922 A1 Mar. 21, 2002

(30) Foreign Application Priority Data

Sep. 20, 2000 (IT) ..... FI2000A0196

(51) Int. Cl.[7] ..... A61F 9/02

(52) U.S. Cl. ..... 2/435; 2/426; 351/44; 351/163

(58) Field of Search ..... 2/426, 428, 435, 2/439, 440, 441, 442, 443, 445, 452; 351/43, 44, 163; 264/328.1

(56) References Cited

U.S. PATENT DOCUMENTS 5,093,940 A * 3/1992 Nishiyama ..... 2/441
5,526,068 A * 6/1996 Markovitz ..... 351/44
5,655,228 A * 8/1997 Chiang ..... 2/428
5,754,271 A * 5/1998 Guglielmetti et al. ..... 351/163
6,317,897 B1 * 11/2001 Chiang ..... 2/428
6,324,702 B1 * 12/2001 Spindelbalker ..... 2/435

FOREIGN PATENT DOCUMENTS

| | | | |
|---|---|---|---|
| EP | 0 525 238 | A1 | 2/1993 |
| EP | 0 824 029 | A1 | 2/1998 |
| GB | 2 312 967 | A | 11/1997 |
| WO | WO98/48905 | A1 | 11/1998 |
| WO | WO 00/38789 | A1 | 7/2000 |

OTHER PUBLICATIONS

"Patent Abstracts of Japan", European Patent Office, for JP06143339, published May 24, 1994, applicant T & M KK, title "Composite Resin Molded Body and Manufacture Thereof".

* cited by examiner

*Primary Examiner*—Gary L. Welch
(74) *Attorney, Agent, or Firm*—Browdy and Neimark, P.L.L.C.

(57) ABSTRACT

Swimming goggles comprising a rigid frame (2) for supporting a pair of glass-shaped transparent members (1), each formed by a flat lens (1*a*) and a flanged bush (1*b*) for the connection to the frame, the bush being made of a mouldable thermoplastic material. The flat lenses are made of a plastic material different from that of the bushes and having a softening temperature higher than that of the material of the bushes and no-mist and/or no-scratch properties. The lenses are perimetrically fixed to the bushes within grooves (6) formed on the respective bushes.

7 Claims, 2 Drawing Sheets

SWIMMING GOGGLES AND MANUFACTURING PROCESS THEREOF

DESCRIPTION

1. Field of the Invention

The present invention relates to the field of the accessories for swimming activities. In particular, it relates to a new type of swimming goggles and the relevant manufacturing method.

2. Description of the Prior Art

The lenses of swimming goggles are mounted within a support frame which, unlike the diver masks, let the swimmer nose free. More precisely, the lenses are supported by bushes which are connected to the support frame through suitable flange means. The term "lens" generally indicates, in the present description, the pair of substantially flat, transparent members placed before the swimmer eyes.

According to a widespread solution a lens and the respective bush are made of a single piece of transparent plastic material. In this way, besides the advantage of a light structure of the goggles, the advantage of a simple manufacture is also achieved, as the lens assembly can be produced with a single moulding operation. The generally used material is a mouldable thermoplastic material, such as polycarbonate, polyamide or polypropylene. The disadvantages of this type of solution consist in that the lenses made of the above materials easily mist over and become scratched.

In order to overcome to the above drawbacks, it has been proposed to make the lenses of glass, limiting the use of the thermoplastic material to the bushes. The glass has a melting temperature far higher than the moulding temperature of the plastic material, whereby the bush can be formed around the glass lens, which has been previously cut, shaped and inserted in the mould. The use of the glass, however, results in some not negligible drawbacks. First, glass has a relatively high specific weight with respect to any plastic material (generally, three times higher approximately), whereby the goggles are heavy. Furthermore, the accidental break of the goggles may result in a danger for the wearer.

When facing the above mentioned problems it has been unexpectedly found a solution which allows to fully mate lightness and safety requirements coming from the use of lenses made of plastic material to the anti-fogging and no-scratch properties typical of the glass lenses.

SUMMARY OF THE INVENTION

According to the invention, there are provided swimming goggles comprising a rigid frame for supporting a pair of glass-shaped transparent members, each formed by a flat lens and a flanged bush for the connection to the frame, the bushes being made of a mouldable thermoplastic material, characterized in that the flat lenses are made of a plastic material different from that of the bushes, having a softening temperature higher than the injection temperature of the material of the bushes, and having anti-fogging and/or no-scratch properties, the lenses being perimetrically fixed to the bushes within grooves formed on the respective bushes.

According to the invention there is also provided a method for manufacturing swimming goggles comprising a rigid frame for supporting a pair of glass-shaped transparent members, each consisting of a flat lens and a flanged bush for the connection to the frame, the bushes being formed in mouldable thermoplastic material, the essential feature of the method consisting in that the connection bushes are formed around the edge of the respective lenses which are made of a plastic material different from that of the bushes and with a softening temperature higher than the injection temperature of the material of the bushes said lenses being previously shaped and inserted inside the relevant mould.

BRIEF DESCRIPTION OF THE DRAWINGS

Features and advantages of the swimming goggles and the relevant manufacturing method according to the present invention will become apparent from the following description of a non-limiting, exemplifying embodiment thereof with reference to the attached drawings, wherein.

DESCRIPTION OF THE PREFERRED EMBODIMENT

Figure 1:
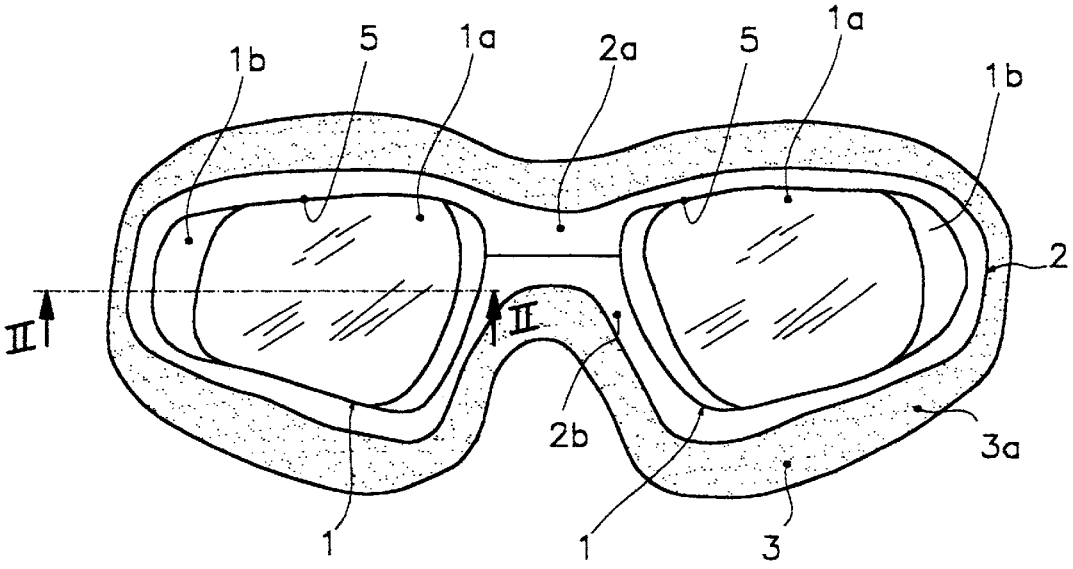
FIG. 1 is a schematic front view of a pair of swimming goggles according to the present invention.
Figure 2:
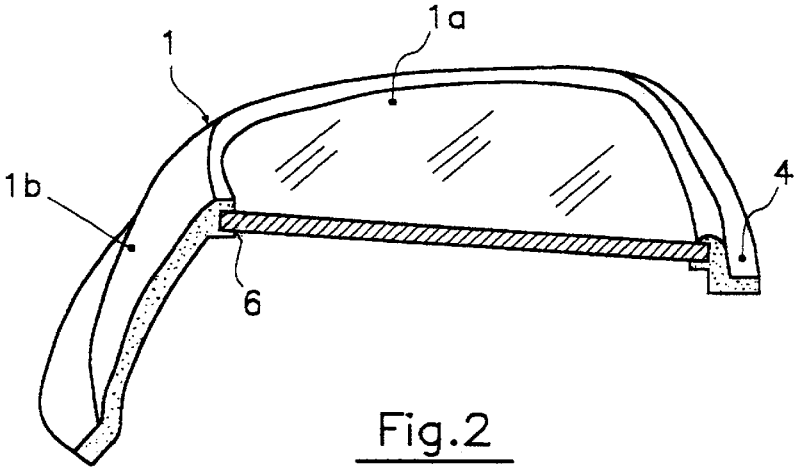
FIG. 2 is a schematic and partial sectional view of the goggles according to lines II—II of FIG. 1 limited to the lens-bush transparent member.

With reference to FIGS. 1 and 2, a pair of swimming goggles according to the invention comprises a pair of transparent lenses 1*a*, mounted inside a support frame 2 which is destined to be applied against the swimmer's face, an elastically yielding seal 3, extending from frame 2, being interposed therebetween. In the embodiment shown in FIG. 1, rigid frame 2 is formed by two parts 2*a* and 2*b*, made integral therebetween in any known way, for example by means of screws or elastic joint.

In order to limit the dimensions of the goggles for obvious hydrodynamic reasons, support frame 2 has a shape matching the curvature of the swimmer's face and flat lenses 1*a* are inserted in openings 5 of the frame through respective connection bushes 1*b*. More precisely, a lens 1*a* and the respective bush 1*b* form a transparent member 1 substantially in the shape of a glass, the flat basis of which is constituted by lens 1*a*, while the side wall is constituted by connection bush 1*b*. In particular, the side wall is of substantially frustoconical shape, having a greater height at the external side (i.e. the side adjacent to the swimmer's temple in the use) and lower height at the inner side (i.e., that adjacent to the swimmer nose).

A peripheral flange 4, radially extending from connection bush 1*b* is engaged in an annular groove, not shown, formed along the edge of relevant opening 5 of rigid frame 2. The groove also contains the bent inner rim of flexible seal 3, while the external border 3*a* of seal 3 is destined to be applied to the forehead, the temples, the cheek-bones and the root of the swimmer's nose, under the tightening effect of an adjustable strap, not shown, fixed to both sides of frame 2.

According to the invention, lens 1*a* and connecting bush 1*b* are made of two different plastic materials, both of them being transparent. As a matter of fact, lens 1*a* is made of a transparent plastic material having anti-fogging and surface hardness features well greater than the conventional plastic material of which connecting bush 1*b* is made by moulding, namely thermoplastic material such as polycarbonate.

Advantageously, the material of the lens 1*a* is a laminated plastic material, preferably cellulose propionate and the like. This material exhibits an hardness well greater than polycarbonate and can be worked at its surface so as to result in substantially better anti-fogging features.

Lens 1*a* is fixed to relevant bush 1*b* by engaging a perimetrical edge of the first one within a groove 6 formed on the second one. To put this solution into practice, according to the invention it is provided to insert lens 1*a* in the connection bush forming mould. Coming into a greater detail with reference to FIGS. 3 and 4, the method for producing the above described goggles needs that lens 1*a* be cut, according to the requested shape, from a laminated plate of the proper plastic material. A pair of lenses 1*a* is then inserted in a bush forming mould 7, whose general features are those of an usual mould for a pair of lens-bush assemblies wholly made of polycarbonate according to the prior art and, therefore, not described in detail.

Figure 3:
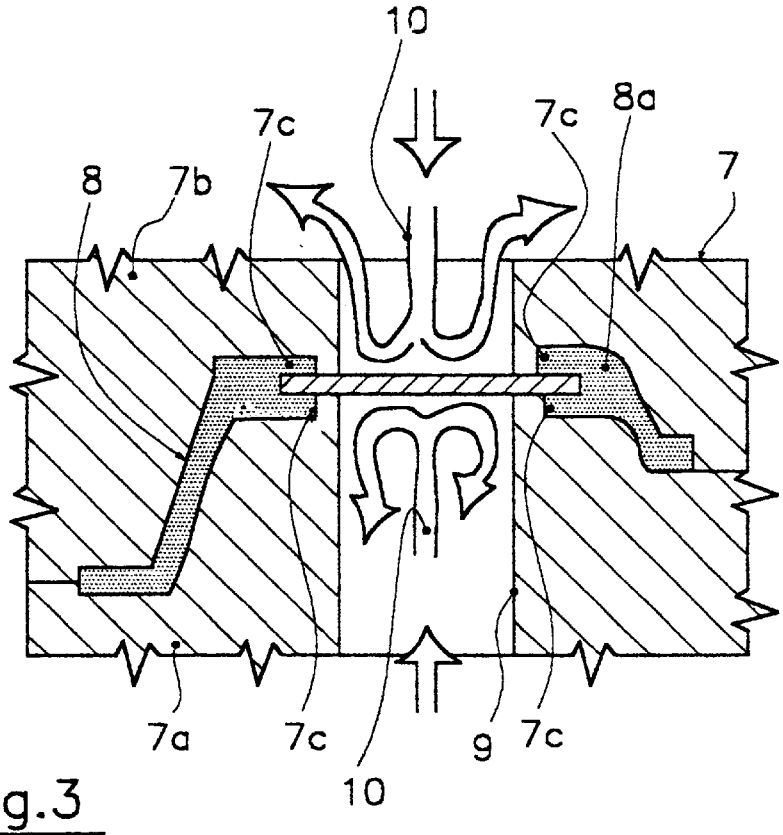
FIG. 3 is a sectional view similar to that of FIG. 2 showing a lens-bush assembly enclosed within the mould in which it is being formed by the method according to the invention.

According to the invention, on the other hand, mould 7 is made into two mould portions 7*a*, 7*b* which give rise, for each bush 1*b*, to a corresponding shaping cavity 8 which is fit for containing lens 1*a* and ensuring the formation of groove 6 for housing the perimetrical edge of the lens. To that end, cavity 8 comprises an annular channel 8*a* wherein the edge of lens 1*a* extends radially and centrally. Lens 1*a* is supported by axial expansions 7*c* at the separation plane of the two mould portions. In addition, a central hole 9 is formed on mould 7 in correspondence to each position in which a lens 1*a* is placed, so that, as shown in FIG. 3, mould portions 7*a* and 7*b* confine the perimeter of lens 1*a*, leaving the central portion thereof free and accessible.

Moulding temperature of the material of connection bush 1*b* is lower than the softening temperature of the material forming lens 1*a*, both being plastic materials. However it is necessary that, during the forming step of bush 1*b*, the mechanical features of the lens material would be not modified. To that end, during the formation of member 1 opening 9 allows lens 1*a* to be cooled in such a way that the heating caused by the contact with the bush material be limited to the peripheral edge only. This effect can be obtained through an oriented flow of a refrigerating fluid 10, such as air.

Figure 4:
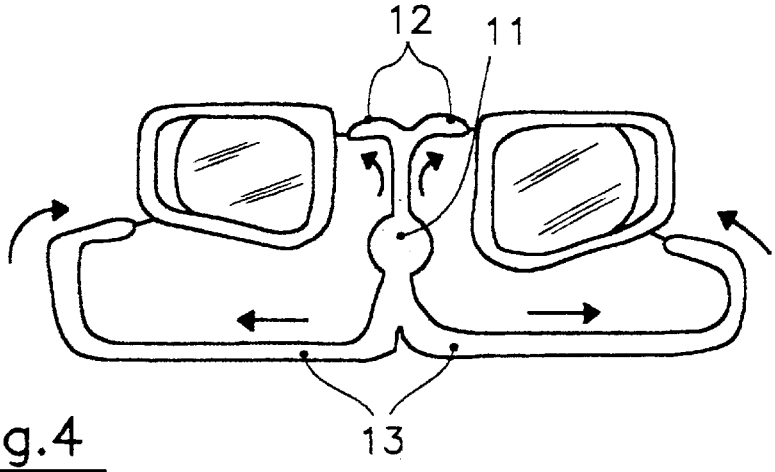
FIG. 4 is a schematic front view similar to that of FIG. 1 showing a pair of lenses integral to the relevant connection bushes, coming from the moulding step in the method according to the invention.

During the formation of bush 1*b* it is necessary, on the other hand, that lens 1*a* would be not displaced inside mould 7 due to the flow of the molten material filling the mould by injection. To that end, according to the invention the solution shown in FIG. 4 is followed. In the figure a pair of lens-bush members is shown as they come out of the moulding step, that is to say with the burrs formed by the material in the material feed channels. It has to be noted that two opposite pairs of feed channels are formed in mould 7 so as to balance the dynamic pressure exerted on lenses 1*a* by the fluid material entering the mould.

In fact, two L-shaped feed channels directly flowing to the inner side of members 1 branch from a vertical injection passage placed substantially at the center of members 1 according to the known art, while two other substantially U-shaped channels supply the material flow to the relevant external sides. The structure of the mould is shown in an indirect way in FIG. 4, where the L-shaped channels, the U-shaped channels and the vertical injection passage are represented by the corresponding injection residues indicated at 12, 13 and 11 respectively, to be removed before mounting the lens-bush assembly to the frame.

Thanks to the above described solution swimming goggles are thus obtained with the typical lightness as those with lens made of polycarbonate and the like, but with no-scratch and anti-fogging properties comparable to those of the glass lens goggles.

The use of two different materials for the lens-bush assembly enables different colours to be used, and this entails advantages not only from the aesthetic standpoint. As a matter of fact, while lens 1*a* will have to be clear and transparent, connection bush 1*b* could be coloured, to prevent the side light from disturbing the direct sight of the user through lens 1*a*.

Variations and/or modifications can be brought to the swimming goggles and the relevant manufacturing method according to the present invention, without departing from the scope of the invention as set forth in the appended claims.

What is claimed is:

1. Swimming goggles comprising a rigid frame for supporting a pair of glass-shaped transparent members, each formed by a flat lens and a flanged bush for the connection to said frame, said bushes being made of a transparent mouldable thermoplastic material, said flat lenses being made of a transparent plastic material different from that of the bushes and having a softening temperature higher than the injection temperature of the material of the bushes and having anti-fogging and/or no-scratch properties, said lenses being perimetrically fixed to the bushes within grooves formed on the respective bushes.

2. Swimming goggles according to claim 1, wherein the material of said lenses is a laminated plastic material.

3. Swimming goggles according to claim 2, wherein said laminated material is cellulose propionate.

4. A method for manufacturing swimming goggles comprising a rigid frame for supporting a pair of glass-shaped transparent members, each formed by a flat lens and a flanged bush for the connection to the frame, the bushes being made of a transparent mouldable thermoplastic material, the connection bushes being formed around the border of the relevant lenses, made of a transparent plastic material different from that of said bushes, said material having a softening temperature higher than the injection temperature of the material of the bushes, said lenses being previously shaped and inserted inside the relevant mould.

5. Method for manufacturing swimming glasses according to claim 4, wherein during the formation of the connection bushes, the thermoplastic material is fed through two opposite pairs of channels, flowing to the inner side and the outer side of each bush, so as to balance the hydrodynamic pressures which would displace the relevant lens within the mould.

6. Method for manufacturing swimming glasses according to claim 4, wherein during the formation of the connection bushes, said lenses are cooled in such a way that the heating caused by the contact with the bushes material be limited to the peripheral edge of the lenses.

7. Method according to claim 6, wherein a flow of refrigerating fluid is supplied through relevant holes formed on said mould to cool said lenses.

* * * * *